US006892485B2

(12) United States Patent
Geyer

(10) Patent No.: US 6,892,485 B2
(45) Date of Patent: May 17, 2005

(54) ELECTRICALLY OPERATED HOUSEHOLD APPLIANCE

(75) Inventor: Johannes Geyer, Gronsdorf (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/462,953

(22) Filed: Jun. 17, 2003

(65) Prior Publication Data

US 2003/0230017 A1 Dec. 18, 2003

Related U.S. Application Data

(63) Continuation of application No. PCT/EP01/13376, filed on Nov. 19, 2001.

(30) Foreign Application Priority Data

Dec. 21, 2000 (DE) ..... 100 64 118

(51) Int. Cl.[7] ..... G09F 13/00

(52) U.S. Cl. ..... 40/541; 40/546; 40/564; 40/580; 362/89; 362/806

(58) Field of Search ..... 40/541, 546, 552, 40/564, 580; 362/89, 91, 806

(56) References Cited

U.S. PATENT DOCUMENTS

| | | | | |
|---|---|---|---|---|
| 2,886,911 A | * | 5/1959 | Hardesty | 40/546 |
| 4,965,950 A | * | 10/1990 | Yamada | 40/546 |
| 5,572,812 A | | 11/1996 | Mastuoka | |
| 5,641,221 A | * | 6/1997 | Schindele et al. | 40/580 |
| 5,809,680 A | | 9/1998 | Scheidler et al. | |
| 5,995,877 A | | 11/1999 | Brueggemann et al. | |
| 6,030,088 A | * | 2/2000 | Scheinberg | 40/580 |
| 6,416,844 B1 | | 7/2002 | Robson | |

FOREIGN PATENT DOCUMENTS

| | | |
|---|---|---|
| DE | 41 14 286 A1 | 11/1992 |
| DE | 44 22 233 A1 | 1/1995 |
| DE | 44 24 847 A1 | 1/1996 |
| DE | 196 15 358 A1 | 11/1996 |
| DE | 195 39 081 C2 | 4/1997 |
| DE | 195 39 840 A1 | 4/1997 |
| DE | 196 45 678 C2 | 5/1998 |
| DE | 197 17 636 A1 | 11/1998 |
| DE | 197 58 496 A1 | 3/1999 |
| EP | 0 403 162 A2 | 12/1990 |

* cited by examiner

*Primary Examiner*—Gary C. Hoge
(74) *Attorney, Agent, or Firm*—John T. Winburn; Russell W. Warnock; Craig J. Loest

(57) ABSTRACT

An outer housing of a household appliance, preferably, in cupboard form, includes an inscription concerning the origin of the appliance on the front side of the housing in the form of a trademark formed from a glass body. To increase the conspicuousness of the mark, the trademark is presented from a structural element or assembly of transparent or translucent material and is connected to at least one light source provided on an inner side of the housing such that an outer surface of the trademark radiates light in a forward direction when the light source is switched on.

12 Claims, 1 Drawing Sheet

ELECTRICALLY OPERATED HOUSEHOLD APPLIANCE

CROSS-REFERENCE TO RELATED APPLICATION

This application is a continuation of copending International Application No. PCT/EP01/13376, filed Nov. 19, 2001, which designated the United States and was not published in English.

BACKGROUND OF THE INVENTION

Field of the Invention

The invention relates to an electrically operated household appliance with an outer housing, preferably, in cupboard form, and an inscription concerning the origin of the appliance provided on the front side of the housing in the form of a trademark.

It is known to provide trademarks, preferably, on or next to an operator control panel disposed in the upper region of the front side of household appliances of the type stated above. For such a purpose, parts of the front side, for example, in the case of a washing machine, the front side of a gripping plate for the detergent dispenser tray, are printed with the trademark.

Another known measure for providing trademarks is that of printing onto an explanatory plate, which is protected, for example, by a glass covering of the operator control panel.

A trademark has the function of gaining adequate attention for promotional purposes, in particular, from those in the trade but also the later customer. This function cannot be satisfactorily performed by a mark provided by being printed on. Therefore, trademarks have, in the past, been provided on the front side as, preferably, chrome-plated metal components. However, such components are, on one hand, too expensive and, on the other hand, have become unfashionable. Their attention-drawing effect has suffered as a result of the fact that they are then often only provided as a monochrome print. Furthermore, it is not possible to combine a technical function with a printed trademark.

SUMMARY OF THE INVENTION

It is accordingly an object of the invention to provide an electrically operated household appliance that overcomes the hereinafore-mentioned disadvantages of the heretofore-known devices of this general type and that fits a household appliance with a trademark such that the trademark has a greater attention-drawing effect and that it is suitable for being incorporated in some technical function or other that can serve for the display technology of a household appliance.

With the foregoing and other objects in view, there is provided, in accordance with the invention, an electrically operated household appliance, including an outer housing having a front side and an inner side, an inscription concerning an origin of the appliance in the form of a trademark disposed on the front side, at least one light source provided on the inner side of the outer housing, and the trademark having an outer surface and a structural configuration of a material that is one of transparent and translucent and being connected to the at least one light source to radiate light from the outer surface of the trademark in a forward direction with respect to the front side when the at least one light source is switched on. Preferably, the outer housing is in the form of a cupboard.

With the objects of the invention in view, there is also provided an electrically operated household appliance, including a housing having a front side, an inscription concerning an origin of the appliance disposed on the front side, the inscription having an outer surface and being a structural configuration of a material that is one of transparent and translucent, and at least one light source being disposed at the housing and being optically connected to the inscription to radiate light generated by the at least one light source from the outer surface of the inscription in a direction away from the front side when the at least one light source is on.

With the objects of the invention in view, there is also provided an electrically operated inscription for a household appliance having a front side, including an inscription concerning an origin of the appliance to be disposed at the front side of the appliance, the inscription having an outer surface and being a structural configuration of a material that is one of transparent and translucent and at least one light source being optically connected to the inscription to radiate light generated by the at least one light source from the outer surface of the inscription and in a direction away from the appliance when the at least one light source is on.

According to the invention, the trademark includes a structural element or assembly of transparent or translucent material and that is connected to at least one light source provided on the inner side of the housing such that the outer surface of the trademark radiates light in a forward direction when the light source is switched on.

The attention-drawing effect with regard to the trademark is much greater in the case of a household appliance fitted out according to the invention than in the case of a print provided by the mark. In particular, the effect is intensified considerably by the fact that, sometimes, the light source can be switched on and at other times it can be switched off.

In accordance with another feature of the invention, the structural element or the assembly is of a plastic and the light-radiating outer surface(s) is (are) disposed opposite the other body (bodies) of the structural element or the assembly on raised parts. The raised parts with radiating surfaces necessarily form prisms that achieve special light effects and, as a result, especially draw attention to them.

Sharp-contoured delimitations of the trademark from its surroundings are possible, in accordance with a further feature of the invention in which the raised parts penetrate through clearances in the front side, the penetrated surface areas of which are at least approximately congruent with the profile of the parts.

In accordance with a concomitant feature of the invention, a particularly advantageous form of the invention acquires an additional technical function if the light source(s) is (are) switched on as soon as the other electrical equipment is under voltage. Apart from the particularly great conspicuousness of the trademark brought about by the alternating light radiation or darkness of the outer surfaces, the display function for operational signaling can be combined therewith if the light source(s) is (are) switched on as soon as a power connector of the appliance is connected to the household power supply system.

For special cases of signaling a specific operating state, the light source(s) can be switched on intermittently in a particularly advantageous way. This, once again, increases the conspicuousness of the radiating trademark.

Other features that are considered as characteristic for the invention are set forth in the appended claims.

Although the invention is illustrated and described herein as embodied in an electrically operated household appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
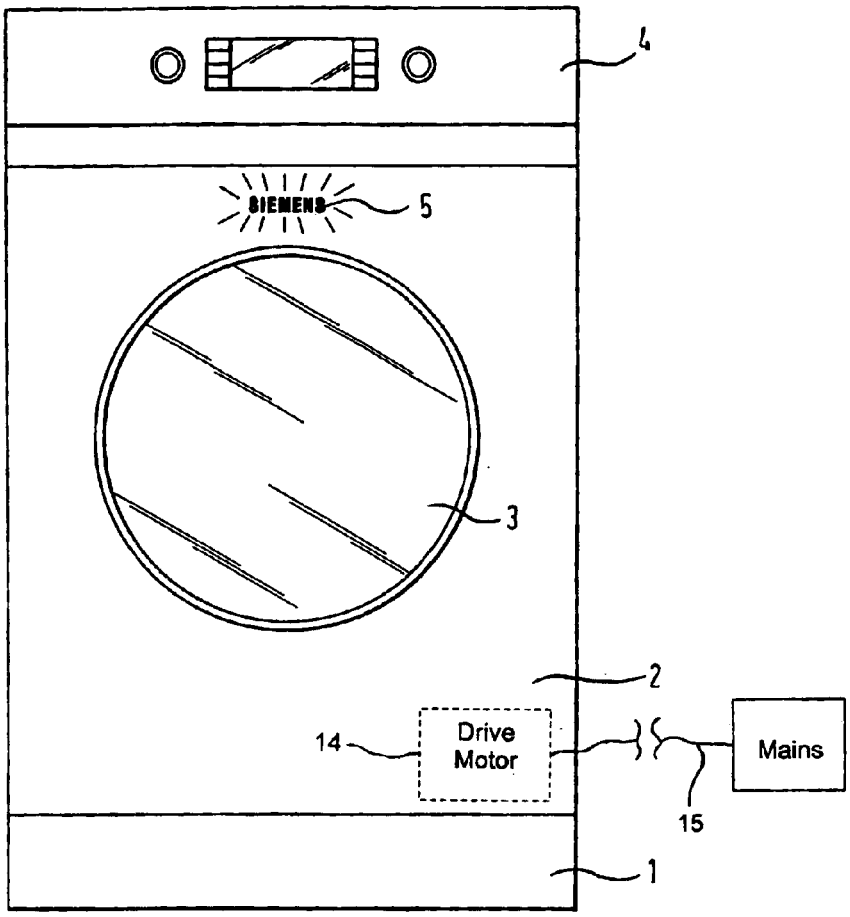
FIG. 1 is an elevational view of a front side of a household washing machine with an illuminated trademark according to the invention.

Referring now to the figures of the drawings in detail and first, particularly to FIG. 1 thereof, there is shown a front side of a washing machine having a maintenance flap 1, a large front part 2 with an integrated porthole window 3, electrical equipment provided as a drive motor 14, a power connector provided as an electrical cord 15 and electrical equipment provided as an operator control panel 4 with operator control elements, not designated any more specifically. Provided on the front part 2 of the machine above the porthole window 3 is a glass body 5 in the form of a trademark. This glass body S is illuminated from the rear by a non-illustrated light source, as still to be explained further below, so that it lights up for the viewer to see, as intended to be made clear by the indicated rays.

Figure 2:
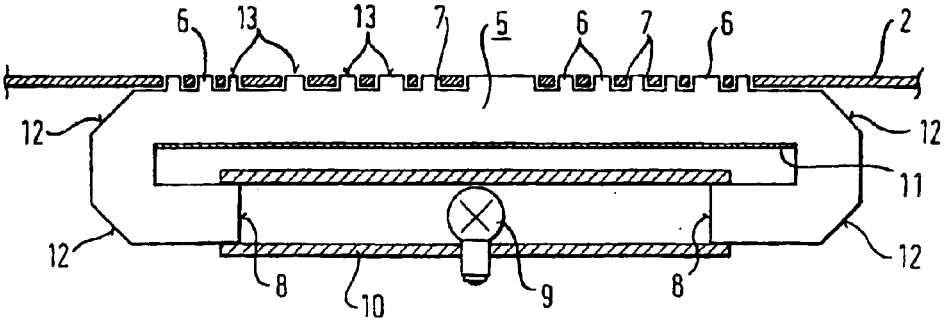
FIG. 2 is a fragmentary, enlarged, cross-sectional view of a configuration for an illuminated trademark according to the invention.

For the sharp-contoured delimitation of the trademark from its surroundings, the front part 2 is provided at the required locations, which are penetrated by raised prisms 6 of the glass body 5, with at least approximately congruent clearances 7, as schematically represented in cross-section on an enlarged scale in FIG. 2. The glass body 5 substantially has the function of a bent light guide with light-entering areas 8, which are irradiated by a light source 9. These parts are disposed in a hollow body 10, which directs the light of the light source 9 by a reflecting inner surface to the light-entering areas 8. For shielding and reflection, the surface of the glass body 5 lying opposite the prisms 6 is also provided with an opaque coating 11. At the bends of the glass body 5, there are boundary surfaces 12 that reflect light rays at an angle and, consequently, direct the light rays from the light source 9 to the front portion of the glass body 5 where they can leave toward the viewer at the radiating outer surfaces 13 of the prisms 6. In a way not represented any more specifically, the prisms or other parts of the front portion of the glass body 5 may be formed for this purpose such that boundary surfaces forming reflections toward the radiating outer surfaces 13 are produced at these forms.

The glass body 5 may also include a number of individual bodies, which are fixed in a spatially immovable manner in relation to one another. They, then, together form an assembly. A number of light sources may also be disposed, in order to illuminate different parts of the glass body or different glass bodies individually. In such a case, the individual illuminations may also be differently colored, by different coloring of the glass bodies or of the light sources. The glass bodies may be of silicate glass or of plastic, depending on the area of use.

I claim:

1. An electrically operated household appliance, comprising:

an outer household appliance housing having a front side and an inner side;

an inscription concerning an origin of the household appliance in the form of a trademark disposed on said front side;

a hollow body provided on said inner side of said outer housing;

at least one light source disposed in said hollow body; and said trademark:

having an outer surface and a structural configuration of a material that is one of transparent and translucent; and being connected to said hollow body and at least one light source to radiate light from said outer surface of said trademark in a forward direction with respect to said front side when said at least one light source is switched on.

2. The household appliance according to claim 1, wherein:

said structural configuration is of a plastic and has raised parts and a body; and said outer surface radiating light is disposed opposite said body on said raised parts.

3. The household appliance according to claim 2, wherein:

said front side defines clearances therein; and said raised parts penetrate through said clearances and have penetrated surface areas at least approximately congruent with a profile of said raised parts.

4. The household appliance according to claim 2, wherein:

said front side has a profile;

said front side defines clearances therein; and said raised parts penetrate through said clearances and have penetrated surface areas at least approximately congruent with said profile of said front side.

5. The household appliance according to claim 1, further comprising electrical equipment, said at least one light source being switched on when said electrical equipment is supplied with voltage.

6. The household appliance according to claim 1, further comprising a power connector to be connected to a household power supply system, said at least one light source being switched on when said power connector is connected to the household power supply system.

7. An electrically operated household appliance, comprising:

a household appliance housing having a front side;

an inscription concerning an origin of the household appliance disposed on maid front side, said inscription having an outer surface and being a structural configuration of a material that is one of transparent and translucent;

a hollow body at said housing; and at least one light source being disposed in said hollow body and said hollow body being optically connected to said inscription to radiate light generated by said at least one light source from said outer surface of said inscription in a direction away from said front side when said at least one light source is on.

8. An electrically operated inscription for a household appliance having a front side comprising:

an inscription concerning an origin of the household appliance to be disposed at the front side of the household appliance, said inscription having an outer surface and being a structural configuration of a material that is one of transparent and translucent;

a hollow body; and at least one light source being optically connected to said inscription by said hollow body, said inscription to radiate light generated by said at least one light source from said outer surface of said inscription and in a direction away from the household appliance when said at least one light source is on.

9. The inscription according to claim 8, wherein:

said structural configuration is of a plastic and has raised parts and a body; and said outer surface radiating light is disposed opposite said body on said raised parts.

10. The inscription according to claim 9, wherein said raised parts are adapted to penetrate through clearances of a surface of the appliance and have penetrated surface areas to be at least approximately congruent with a profile of the surface of the appliance.

11. The inscription according to claim 8, wherein said at least one light source is adapted to be switched on when electrical equipment of the appliance is under voltage.

12. The inscription according to claim 8, wherein said at least one light source is adapted to be switched on when a power connector of the appliance is connected to a household power supply system.

* * * * *